US010398622B2

(12) United States Patent
Dills

(10) Patent No.: US 10,398,622 B2
(45) **Date of Patent: *Sep. 3, 2019**

(54) MASSAGE DEVICE WITH REMOTE CONTROL

(71) Applicant: AMOR Gummiwaren GmbH, Arnstadt (DE)

(72) Inventor: Michael Dills, Arnstadt (DE)

(73) Assignee: AMOR Gummiwaren GmbH, Arnstadt (DE)

( * ) Notice: Subject to any disclaimer, the term of this patent is extended or adjusted under 35 U.S.C. 154(b) by 0 days.

This patent is subject to a terminal disclaimer.

(21) Appl. No.: 15/713,970

(22) Filed: Sep. 25, 2017

(65) Prior Publication Data

US 2018/0085285 A1 Mar. 29, 2018

(30) Foreign Application Priority Data

Sep. 26, 2016 (EP) ..... 16190607

(51) Int. Cl.
*A61H 23/02* (2006.01)
*A61H 19/00* (2006.01)
(Continued)

(52) U.S. Cl.
CPC ..... *A61H 23/0263* (2013.01); *A61H 19/32* (2013.01); *A61H 19/40* (2013.01);
(Continued)

(58) Field of Classification Search
CPC ..... A61H 23/0263; A61H 2201/0107; A61H 2201/1685; A61H 2201/5097;
(Continued)

(56) References Cited

U.S. PATENT DOCUMENTS 9,132,058 B2 * 9/2015 Imboden ..... A61H 19/00
2007/0129599 A1 * 6/2007 Nan ..... A61H 19/44 600/38

(Continued)

FOREIGN PATENT DOCUMENTS

CN 103070767 B 6/2015
DE 202013105399 U1 1/2014

(Continued)

OTHER PUBLICATIONS

English Translation for WO 02/38100 A2, May 2002 (Year: 2002).*
EP 16 19 0607 Search Report dated Mar. 7, 2017.

*Primary Examiner* — Quang D Thanh
(74) *Attorney, Agent, or Firm* — Jansson Munger McKinley & Kirby Ltd.

(57) ABSTRACT

A massage device with remote control adapted to massage body parts. The massage device includes a vibration-producing part which has a housing, inside the housing is an oscillation-producing device, an energy storage unit, a control unit, and a wireless data communications device. The vibration-producing part is connected to a cable and a plug element is provided. The plug element is equipped with two charging electrodes and with a PCB antenna for receiving and sending signals, and a vibration-receiving part which has an opening to hold the vibration-producing part such that the vibration-producing part is at least partially surrounded by the vibration-receiving part. The vibration-producing part is configured as a modular element which is adapted to be connected to the vibration-receiving part to form the device.

11 Claims, 3 Drawing Sheets

(51) Int. Cl.

| | |
|---|---|
| ***H01R 12/71*** | (2011.01) |
| ***H01R 13/70*** | (2006.01) |
| ***H01R 13/52*** | (2006.01) |
| ***H01Q 1/38*** | (2006.01) |
| ***H01Q 9/42*** | (2006.01) |
| *H01R 13/66* | (2006.01) |
| *H01Q 1/46* | (2006.01) |
| *H01R 24/62* | (2011.01) |

(52) U.S. Cl.
CPC ..... *A61H 19/44* (2013.01); *H01Q 1/38* (2013.01); *H01Q 9/42* (2013.01); *H01R 12/714* (2013.01); *H01R 13/52* (2013.01); *H01R 13/70* (2013.01); *A61H 2201/0107* (2013.01); *A61H 2201/1685* (2013.01); *A61H 2201/5015* (2013.01); *A61H 2201/5097* (2013.01); *H01Q 1/46* (2013.01); *H01R 13/6658* (2013.01); *H01R 24/62* (2013.01); *H01R 2201/12* (2013.01)

(58) Field of Classification Search
CPC ..... A61H 2201/5015; A61H 19/40; A61H 19/44; A61H 19/32; H01Q 1/38; H01Q 9/42; H01Q 1/46; H01R 12/714; H01R 13/52; H01R 13/70; H01R 13/6658; H01R 2201/12; H01R 24/62
See application file for complete search history.

(56) References Cited

U.S. PATENT DOCUMENTS

| | | | | |
|---|---|---|---|---|
| 2009/0012355 | A1* | 1/2009 | Lin | A61H 19/34 600/41 |
| 2014/0046127 | A1* | 2/2014 | Topolovac | A61H 19/44 600/38 |
| 2014/0357943 | A1 | 12/2014 | Greaves | |
| 2015/0141883 | A1* | 5/2015 | Wu | A61H 19/50 601/80 |
| 2015/0305971 | A1* | 10/2015 | Davis | A61H 19/34 600/38 |
| 2015/0328082 | A1* | 11/2015 | Jiang | A61H 19/00 600/38 |
| 2016/0199250 | A1* | 7/2016 | Dills | A61H 23/0263 601/70 |

FOREIGN PATENT DOCUMENTS

| | | | | |
|---|---|---|---|---|
| EP | 3042643 | A1 | 7/2016 | |
| WO | WO02/38100 | A2 * | 5/2002 | A61H 19/00 |

* cited by examiner

MASSAGE DEVICE WITH REMOTE CONTROL

CROSS REFERENCE TO RELATED APPLICATION

This application claims priority based on European Patent Application No. EP 16 190 607.8, filed Sep. 26, 2016, the contents of which are incorporated by reference in its entirety.

FIELD OF THE INVENTION

The field is generally related to a massage device and, more particularly, to a massage device with remote control for the massage of body parts, especially the erogenous zones and genitals.

BACKGROUND OF THE INVENTION

Massage devices of the type indicated above are also commonly known as vibrators, which come in many different shapes and sizes. There are, for example, battery-operated vibrators with direct control or control by way of a cable and also vibrators in the form of "love balls" with remote control based on the Bluetooth protocol, for example. Direct-control vibrators on which additional external elements can be mounted to intensify the vibrational effect are also known.

OBJECTS OF THE INVENTION

The disadvantage of most of the above-mentioned vibrators is that they have only a single external shape, which is fixed at the time of manufacture, and they therefore offer no customizability at all. Users who would prefer vibrators with different shapes have no choice but to acquire additional vibrators of the same type, which results in additional cost.

It is therefore the object of the present invention to overcome at least partially the above-cited disadvantages and to provide a massage device with remote control which can be produced at low cost; which operates in reliable, waterproof fashion; which has external components, i.e., the components which transmit the vibrations, with a flexibly adaptable shape; which has an easily rechargeable battery; and which can be controlled flexibly by up-to-date wireless data transmission technologies. This object is achieved by the device disclosed herein.

SUMMARY OF THE INVENTION

According to the invention, there is provided a massage device with remote control adapted to the massage of body parts, the massage device having a vibration-producing part comprising a housing and in the housing an oscillation-producing device, an energy storage unit, a control unit, and a wireless data communications unit, wherein the vibration-producing part is connected to one end of a cable, to the other end of which a plug element is provided, this plug element being equipped with two charging electrodes for connection to a charging device and with a PCB (printed-circuit-board) antenna for receiving radio signals for the wireless data communications unit and for sending signals from it, and a vibration-receiving part, which comprises an opening to hold the vibration-producing part in such a way that the vibration-producing part, when in the installed state, is at least partially surrounded by the vibration-receiving part; wherein the vibration-producing part is configured as a modular element, which is adapted to be connected to at least one vibration-receiving part to form the massage device with remote control.

Thus the possibility is created of producing a modular massage device at very low cost, because, thanks to its modularity, there is no need to design components specifically adapted to the geometry of the vibration-producing part. For the various purposes which the massage device can serve, it is now possible to use a common technical platform for vibration production, control, power supply, and data communications. In addition, the end user obtains the advantage that he can use a plurality of vibration-receiving parts or adapters on one vibration-producing part, which reduces the acquisition costs considerably. The vibration-receiving part can be given the shape of nearly any conceivable sex toy, wherein the shape of each individual vibration-receiving part is compatible with the vibration-producing part. The additional possibility is also created of arranging more than one vibration-receiving part on a single vibration-producing part, as a result of which practically no limit is imposed on the imagination with respect to the use of the massage device according to the invention. The flexible manner in which the remote control function works makes it much easier to use the device, which significantly increases the benefit to the buyer or user of the device.

It is especially advantageous for the plug element to be flat and for the charging electrodes to be Universal Serial Bus (USB) compatible. The very widely used USB technology makes it possible both to charge the energy storage unit and/or to transmit data. The flat plug element comprises in this case a configuration similar to that of a USB-A plug, which can be inserted into a corresponding USB port in the same way as a USB memory stick. These types of connecting ports can be found on a wide variety of devices such as PCs, laptops, notebooks, tablet computers, power adapters (for 12/110/120/220 V) and the like, and provide adequate charging current under the USB standard (e.g., up to 500 mA at 5 V according to USB 2.0).

The charging electrodes and the PCB antenna are preferably mounted on one single (printed) circuit board. It is advantageous in this case for the charging electrodes to be arranged on one side of the board and the PCB antenna on the other side. The PCB antenna, also called a printed antenna, is configured so that, for example, any desired shape can be applied at low cost as a copper or other metal layer on a conventional circuit board. As a result, a compact component can be obtained, which reduces both the amount of space which is required and the cost. Alternatively, the charging electrodes and the PCB antenna can be arranged on the same side of the circuit board. This results in a plug element with an even simpler structure. It is also possible for charging electrodes to be arranged on both sides of the board, so that the plug element can be inserted in user-friendly fashion into a USB port or some other corresponding type of charging port in either orientation. For this purpose, a logic circuit is required, which recognizes the positive pole and the negative pole as appropriate.

It is also advantageous for the PCB antenna to be adapted to the sending and receiving of radio signals by the use of the Bluetooth (according to IEEE 802.15.1), NFC (Near-Field Communication), WLAN (WiFi; according to IEEE 802.11), GSM (Global System for Mobile Communications), UMTS (Universal Mobile Telecommunications Service), or LTE (Long-Term Evolution) standard or any other suitable mobile data transmission standard.

It is advantageous for the vibration-producing part, the cable, the transition between the vibration-producing part and the cable, and the plug element to be impervious to fluids. Thus not only the vibration-producing part, which, for example, is introduced together with the vibration-receiving part into a body opening, but also the retrieval cord or cable and the plug element satisfy the hygiene regulations applicable to devices of this type such as IP67 (DIN EN 60528). The vibration-producing part, the cable, and the plug element can therefore be cleaned easily, and they offer no openings into which liquid could intrude, which would impair the function of the massage device.

It is preferred that the cable comprise two strands; in particular, it is advantageous for at least one cable strand to be configured as a coaxial cable. This guarantees that the high-frequency antenna signal is exposed to minimum possible interference and can be transmitted with adequate shielding to the wireless communications unit in the interior of the housing of the vibration-producing part. The influence arising from the flow of current coming from the USB charging voltage source (direct voltage) is thus minimized also.

It is also advantageous for the vibration-producing part to be held by a press-fit in the opening of the vibration-receiving part. This ensures secure retention, the reliability of which will be essentially unaffected by the vibrations of the vibration-producing part. The massage device thus acts, during operation, as an integral, solid unit, but a unit which is modular in design so that the vibration-receiving part can be cleaned or replaced.

The vibration-receiving part is preferably made of silicone, TPE, or any other suitable thermoplastic material. These materials are noncritical from a hygienic standpoint and comprise pleasant and therefore especially well-adapted haptic properties for use on and/or in the body.

It is especially advantageous for the energy storage unit and the oscillation-producing device to be arranged one behind the other in the longitudinal direction of the housing. This saves space and simultaneously creates the possibility of using low-cost components. In a similar manner, the control unit and the wireless data communications unit are preferably located on a circuit board which is arranged in the longitudinal direction of the housing parallel to the energy storage unit.

Also according to the invention is a massage arrangement with a remote controlling device and at least one massage device as described above, wherein the remote controlling device is adapted to control each of the massage devices independently of each other or to control at least some of them in common. This means that a single remote control device, which is preferably configured as a smartphone, can control more than one massage device and optionally run a different program for each one. Thus, the application or "app" of a smartphone can control three massage devices, for example, where two of these can run the same vibration program while the third runs a different vibration program.

The plug element preferably comprises a gripping area on its surface. The gripping area is formed near the end of the plug element to which the cable or the ends of the strands are connected. Thus it becomes possible to insert the plug element into the charging port and to pull it back out again easily. The gripping area can be in the form of a series of grooves or a convexity on the surface of the plug element. Other effective embodiments which do not affect the function of the plug element or of the antenna element are also possible.

The plug element and/or the cable can comprise a biocompatible plastic sheath over at least a portion of their surfaces. Thus the components such as the circuit board, antenna, and the connecting parts to the cable strands are protected from corrosion, for example. It is especially preferable for the biocompatible plastic sheath to be applied by injection-molding. As a result, an integrally configured plug element is obtained, which minimizes the surface area which could be exposed to damage or attack from the outside.

The material for the plastic sheath and also for the vibration-producing part with the transition to the cable is preferably a thermoplastic such as acrylonitrile-butadiene-styrene copolymer (ABS) or a comparable plastic with similar properties. These thermoplastic materials are insensitive to standard commercial lubricants and cleaning agents and are also neutral in taste and odor.

The material of the massage device is preferably UV-proof, odorless, and taste-neutral. It is also possible to use materials of different colors.

The charging contacts of the plug element advantageously comprise a coating with a metal or a metal alloy in the form of, for example, a plating with gold or a gold alloy or in the form of a surface enhancement with some other metal or metal alloy.

BRIEF DESCRIPTION OF THE DRAWINGS

The drawings illustrate a preferred embodiment including the above-noted characteristics and features of the device. The device will be readily understood from the descriptions and drawings. In the drawings.

DETAILED DESCRIPTION OF THE EMBODIMENTS

Figure 1:
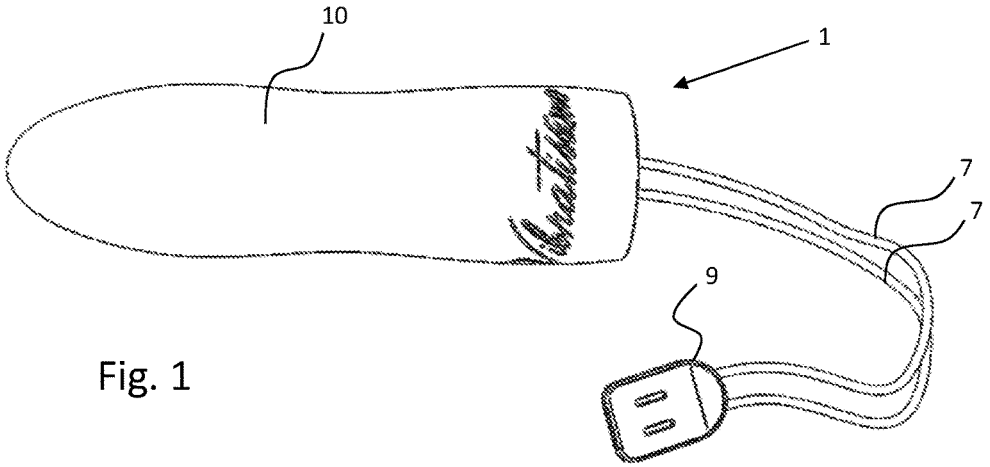
FIG. 1 is a perspective view of a first preferred embodiment of the massage device according to the invention.

FIG. 1 shows a perspective view of a first preferred embodiment of the massage device according to the invention. The massage device 1 comprises an essentially cylindrical vibration-producing part, which, in FIG. 1, is held in its entirety in the vibration-receiving part 10 and for this reason cannot be seen. At one end, the vibration-producing part is connected by a cable 7, which, in the embodiment shown here, is formed by two strands or conductors, to a plug element 9.

Figure 2:
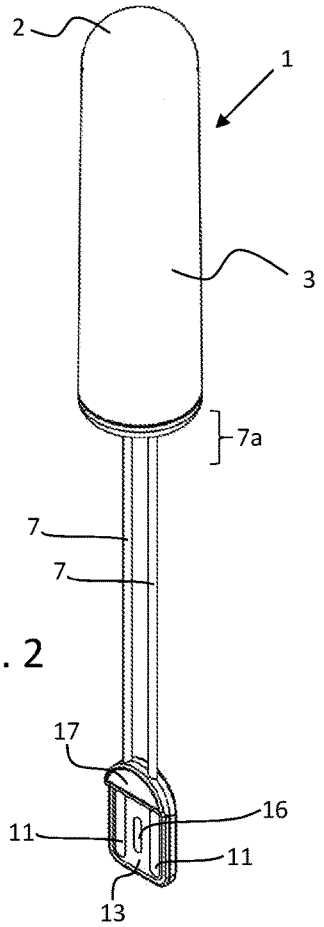
FIG. 2 is a perspective view of the device of FIG. 1 without the vibration-receiving part.
Figure 3:
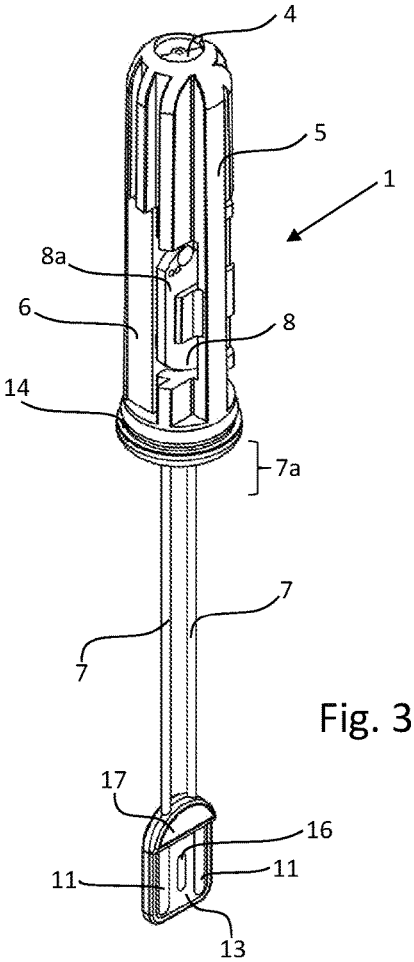
FIG. 3 is a perspective view of the device of FIG. 1 without the housing of the vibration-producing part.

Each of FIGS. 2 and 3 shows a part of the massage device according to the invention, wherein vibration-receiving part 10 has been omitted. Thus, in FIG. 2, vibration-producing part 3 can be seen, housing 2 of which is essentially cylindrical and which comprises at one end a hemispherical end piece. Dimensions for housing 2 of vibration-producing part 3 which can be cited as examples are a length in the range of approximately 50 mm to approximately 100 mm, the length in the embodiment shown here being 67 mm, and a diameter in the range of approximately 10 mm to 20 mm, preferably 17 mm. The rounded tip is designed in such a way that vibration-producing part 3 can be introduced easily into the receptacle or opening of vibration-receiving part 10. Cable 7 and plug element 9 are described in detail further below with reference to FIG. 4.

In a manner similar to that of FIG. 2, FIG. 3 shows the massage device according to the invention, wherein both vibration-receiving part 10 and housing 3 have been omitted. Inside housing 2 (not shown in FIG. 3) on a mounting or housing frame 5, vibration-producing part 3 comprises an oscillation-producing device 4, an energy storage unit 6, and a printed circuit board 8 with a control unit and a wireless data communications unit 8*a*. These electrical components, which are familiar to the expert in the field, are functionally coupled together, i.e., electrically connected, in the interior of housing 2 in the conventional manner as generally known to the expert. The components which can be seen in FIG. 3 are usually covered by housing 2, not shown in FIG. 3, which therefore protects the inner components and one end of which is sealed off against a cover piece in a liquid-tight manner by a seal or O-ring 14. Housing 2 is usually set down onto the side of the cover piece provided with the seal and bonded to it. Latching connections, threaded connections, or other comparable connection types are also conceivable here. The connection is usually configured in such a way that housing 2 cannot be easily detached from the cover piece containing the cable pass-through. The pass-through of cable 7 through the cover piece is also configured to be impervious to liquids.

During operation, oscillation-producing device 4, such as an electric motor with a weight seated eccentrically on a shaft, is provided with power from energy storage unit 6; this causes vibration-producing part 3 to oscillate back and forth and thus to vibrate in response to signals from the control unit. The control unit on circuit board 8 receives its control commands via the wireless data communications unit 8*a* also arranged on circuit board 8; the data communications unit 8*a* is also supplied with power from energy storage unit 6 and is provided with radio signals for control purposes by a remote controlling device such as a smartphone, a laptop or other PC, or a similar mobile operating platform. The control unit can also have a data storage device for storing program sequences, as a result of which it is possible to program and to control the massage device with internally or externally prepared vibration sequences. In this case, the control signals are sent from the data storage device. Direct control via the remote controlling device is also possible.

Mounting 5 is formed out of, for example, thermoplastic material such as acrylonitrile-butadiene-styrene (ABS) over the entire length of vibration-producing part 3 and comprises web-like projections, to which the components are bonded with an adhesive, latched, or clamped. In the embodiment shown here, elongated energy storage unit 6 is arranged as extending from the end near the cover piece. Following it in the longitudinal direction is oscillation-producing device 4 at the end opposite the cover piece. Circuit board 8 with the control unit and the wireless data communications unit 8*a* and optionally with a data storage device extends in the longitudinal direction, parallel to energy storage unit 6. As a result, an especially compact structure is obtained for the vibration-producing part, wherein the geometry facilitates the use of standard, mass-produced commercial components and minimizes the effort required to adapt them to the structure of the mounting or housing frame 5.

So that the components in the interior of vibration-producing part 3 can be supplied with current and with an antenna signal and so that they can also transmit a signal to the outside, vibration-producing part 3 is connected via a transition 7*a* to a plug element 9 by a cable 7, which, in the embodiment shown, is formed by two strands or conductors, which pass through the housing cover piece sealed by seal 14 in a liquid-tight manner.

Figure 4:
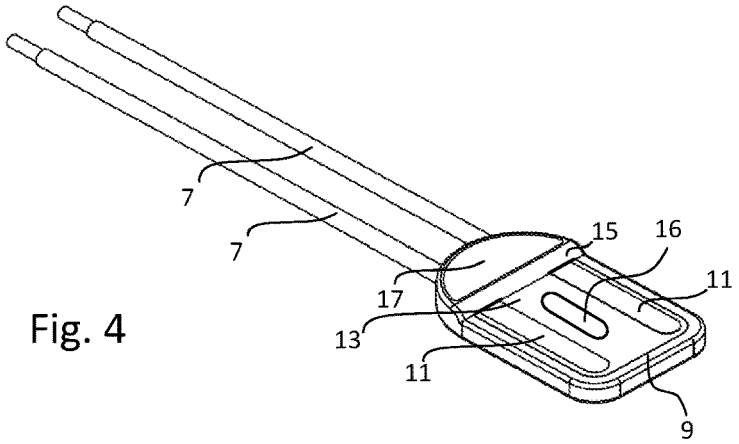
FIG. 4 is a perspective view of a plug element, with attached cable, of the preferred embodiment of FIG. 1.

As can be seen in FIG. 4, plug element 9 is configured as a flat plug and comprises on its top surface two charging electrodes 11 extending parallel to each other in the longitudinal direction; these electrodes are compatible with a USB-A port. Up as far as freely exposed charging electrodes 11, plug element 9 is overmolded by a sheath 15, which consists of a thermoplastic material such as acrylonitrile-butadiene-styrene (ABS). On the top surface 13, at the end facing cable 7, sheath 15 comprises a gripping area 17, which, in the embodiment shown, is in the form of a convexity. Gripping area 17 enables plug element 9 to be handled more easily when it is to be inserted into a corresponding USB port or pulled back out. Approximately in the middle of top surface 13 of plug element 9, an elongated recess 16 can be seen; the reason for its presence is that, in the present embodiment, plug element 9 is produced by injection-molding, and the component must be held in the proper position by a tool. Elongated recess 16 is of no importance to the vibration function, to charging, or to the control of the massage device; its only role is to facilitate production.

Figure 5:
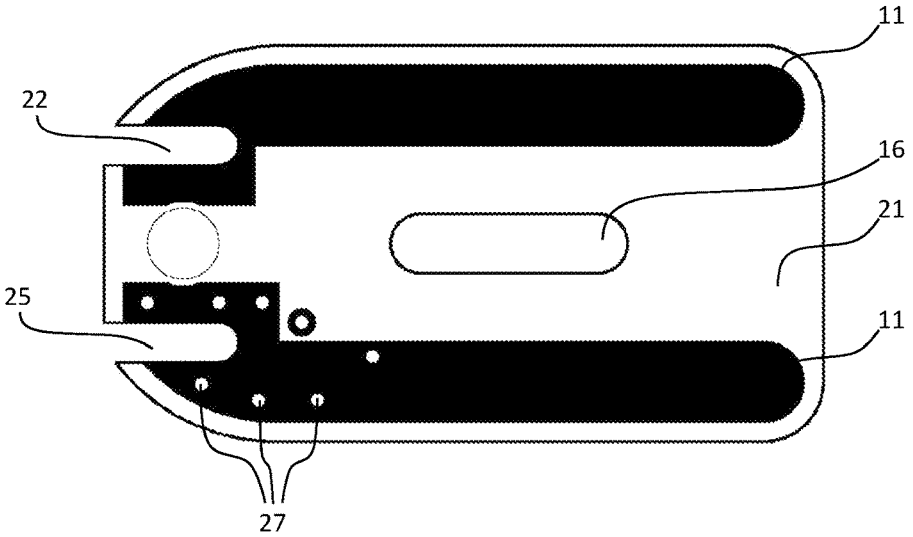
FIG. 5 is a plan view of the top surface of a circuit board of the plug element of a preferred embodiment of FIG. 1.
Figure 6:
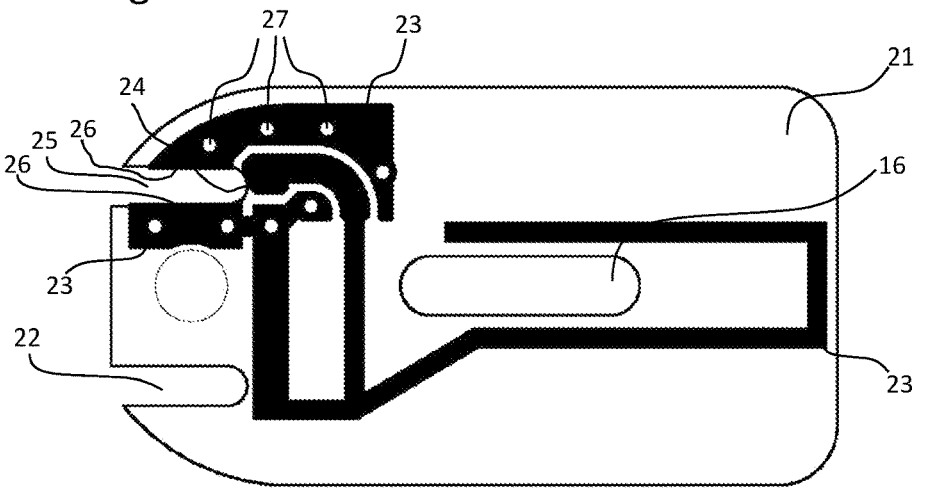
FIG. 6 is a plan view of the bottom surface of the circuit board of the plug element of the preferred embodiment of FIG. 1.

FIGS. 5 and 6 show plan views of the top and bottom surfaces of circuit board 21 with two charging electrodes 11 and PCB antenna 23, which form the core of plug element 9. It should be noted that, after the application of the material for charging electrodes 11 and the PCB antenna 23 and after the cable strands have been connected, circuit board 21 is then also overmolded by the injection-molding technique to create a plastic sheath, only after which is plug element 9 completely finished.

FIG. 5 shows the top surface of the circuit board, on which the two charging electrodes, which extend parallel to each other in the longitudinal direction, have been applied. The dimensions, i.e., the distance between two charging electrodes 11 and their length, are calculated in such a way that plug element 9 can be inserted into a corresponding USB port for the purpose of charging. Charging electrodes 11 are brought into contact with the terminals of the two cable strands in first recess 22 and in second recess 25. In the preferred embodiment, cable 7 is formed out of two strands, wherein the first strand is a simple cable with a litz wire, the end of which is connected to the positive charging electrode; in FIG. 6, this is upper charging electrode 11. The second strand of cable 7 is in the form of a coaxial cable, wherein the outer conducting layer is connected in second recess 25 to charging electrode 11 serving as the ground pole. The white dots in the left part of the ground electrode indicate the through-contacts to the bottom surface of the circuit board, as will be described again below with reference to FIG. 6.

FIG. 6 shows the bottom surface of circuit board 21, to which PCB antenna 23 has been applied as a conductive layer by the known technique. A PCB antenna of this type is characterized by a compact structure. In the present invention, it is advantageous that PCB antenna 23 is located in plug element 9 a good distance away from the printed circuit and the components of the wireless data communications unit in vibration-producing part 3, because in this way secondary excitations and thus interference related to the high-frequency properties of the PCB antenna can be considerably reduced.

The form of the printed antenna traces is optimized for good dispersion characteristics, high efficiency in reception and transmission, and adequate bandwidth. PCB antenna 23 is connected in second recess 25 to one strand of cable 7, namely, to the coaxial strand. The internal conductor of the coaxial cable, also called the core, is electrically connected, i.e., soldered to contact area 24 of PCB antenna 23 at the end of second recess 25. The external conductor of the coaxial cable is electrically connected, i.e., soldered, to contact areas 26 of antenna element 23 along the long sides of second recess 25. It is also possible to establish these connections by the use of an adhesive or some other suitable contacting technique. As can be seen in FIG. 6, there is no connection in first recess 22 of circuit board 21 between the stranded wire of cable 7 and a trace printed on the bottom surface.

By use of the coaxial cable, it is possible, for example, to send the Bluetooth signal received in the 2.4-GHz band to the wireless data communications unit or to send a Bluetooth signal from the communications device. The wave resistance of the coaxial cable is calculated in such a way that optimum transmission and reception properties are ensured.

Instead of a PCB antenna, it is also possible to use other types of antennas, such as a linear antenna, a loop antenna, or a slot antenna.

Figure 7:
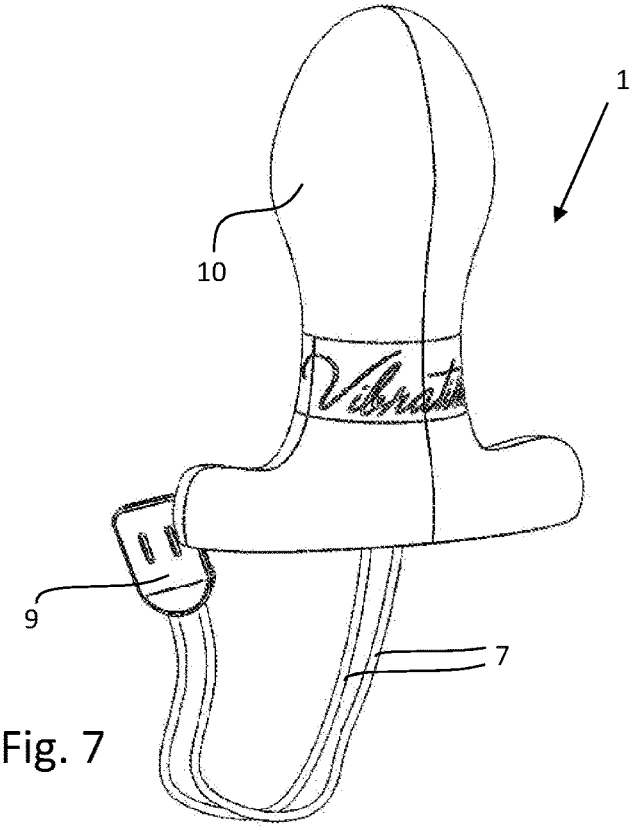
FIG. 7 is a perspective view of a second embodiment of the massage device.
Figure 8:
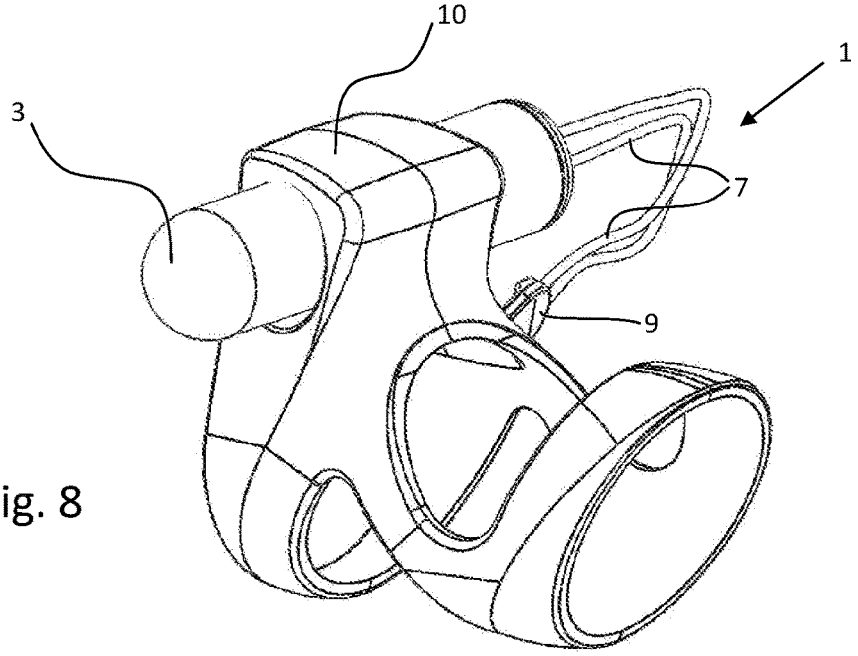
FIG. 8 is a perspective view of a third embodiment of the massage device.

FIGS. 7 and 8 show perspective views of a second and third embodiment, respectively, of the massage device according to the invention. The only difference pertains to the shape of vibration-receiving part 10. Vibration producing part 3 is configured in modular fashion as already described with reference to FIGS. 2 and 3; i.e., the same vibration-producing part 3 can be used in completely different types of vibration receiving parts.

It can be seen that, in FIG. 7, the entire vibration-producing part 3 is accommodated in the mounting of vibration-receiving part 10. In the embodiment shown in FIG. 8, vibration-producing part 3 is held in the mounting of vibration-receiving part 10 in such a way that it is only partially surrounded. The mounting is usually configured so that there is a press-fit between the vibration-producing part and the mounting. The outside diameter of vibration-producing part 3 will therefore be slightly larger than the inside diameter of the mounting of vibration-receiving part 10.

Because vibration-producing part 3 vibrates along with its entire housing 2 when it is in operation, the vibration is also transmitted essentially in its entirety to vibration-receiving part 10.

As can be derived from FIGS. 7 and 8, the shape of vibration-receiving part 10 can vary considerably, so that the desires of sex-toy customers can be satisfied over the widest possible range. Examples of such shapes are conventional female vibrator shapes in various lengths and diameters, with or without a clitoris stimulator attached to the side; relatively small vibrator adaptors, which surround only about half or two-thirds of the length of vibration-producing part 3; ring-shaped adapters; two-person vibrators; male vibrators; penis ring adapters; anal adapters, and the like.

With the subject matter of the invention, a massage device with remote control is provided, which makes possible low-cost production; reliable, liquid-tight operation; a choice of various external shapes of the vibration-transmitting components; simple charging of the energy storage unit; and flexible control by up-to-date wireless data transmission technologies.

A wide variety of materials are available for the various parts discussed and illustrated herein. While the principles of this device have been described in connection with specific embodiments, it should be understood clearly that these descriptions are made only by way of example and are not intended to limit the scope of the device.

The invention claimed is:

1. A massage device adapted to massage body parts, the massage device comprising:

a vibration-producing part comprising a housing and in the housing a device for producing oscillation such as an electric motor, an energy storage unit, a control unit, and a wireless data communications unit, the vibration-producing part being connected to a first end of a cable and a plug element is provided on a second end of the cable, the plug element comprising two charging electrodes for connection to a charging device, a printed circuit board (PCB) and a PCB antenna for receiving and sending radio signals for the wireless data communications unit wherein the plug element is flat and configured for insertion into a Universal Serial Bus (USB) socket, and a vibration-receiving part having an opening to hold the vibration-producing part in such a way that the vibration-producing part, when in an installed state, is at least partially surrounded by the vibration-receiving part and the vibration-producing part being configured as a modular element which is adapted to be connected to the vibration-receiving part to form the massage device.

2. The massage device of claim 1 wherein: (a) the charging electrodes are arranged on one side of the printed circuit board and the PCB antenna is arranged on the other side of the printed circuit board; or (b) the charging electrodes and the PCB antenna are arranged on a same side of the printed circuit board.

3. The massage device of claim 1 wherein the PCB antenna is adapted to the transmission and reception of radio signals according to mobile data transmission standards.

4. The massage device of claim 1 wherein the vibration-producing part, the cable, and a transition section from the vibration-producing part to the cable and the plug element are configured to be impervious to fluids.

5. The massage device of claim 4 wherein the cable comprises two strands.

6. The massage device of claim 1 wherein the vibration-producing part is held by a press-fit in an opening of the vibration-receiving part.

7. The massage device of claim 1 wherein the vibration-receiving part is made of silicone, or Thermoplastic Elastomer (TPE).

8. The massage device of claim 1 wherein the energy storage unit and the electric motor are arranged consecutively in a longitudinal direction of the housing.

9. The massage device of claim 1 wherein the control unit and the wireless data communications unit are located on another printed circuit board which is arranged in a longitudinal direction of the housing parallel to the energy storage unit.

10. A massage assembly comprising a remote control device and at least one massage device of claim 1 wherein the remote control device is adapted to control each of the at least one massage devices independently of each other or to control more than one massage device in common.

11. The massage assembly of claim 10 wherein the remote control device is a smartphone.

* * * * *